US005524892A

United States Patent [19]

Karp

[11] Patent Number: 5,524,892

[45] Date of Patent: Jun. 11, 1996

[54] DUAL PURPOSE GOLF TRAINING DEVICE

[76] Inventor: Theodore M. Karp, 1069 NE. 204th Ter., North Miami, Fla. 33179

[21] Appl. No.: 380,398

[22] Filed: Jan. 30, 1995

[51] Int. Cl.[6] ..... A63B 69/36

[52] U.S. Cl. ..... 473/206; 473/201; 473/203; 473/224

[58] Field of Search ..... 273/186.1, 186.2, 273/186.3, 187.4, 187.5, 194 B, 163 R, 163 A, 164.1, 81 R, 165, 81.2, 81.3, 81.4, 81.6, 81 D

[56] References Cited

U.S. PATENT DOCUMENTS

| | | | |
|---|---|---|---|
| 2,710,190 | 6/1955 | Schimansky | 273/81.4 |
| 3,106,403 | 10/1963 | Kirkman | 273/186.3 |
| 3,951,415 | 4/1976 | Stuart | 273/163 A |
| 4,515,368 | 5/1985 | Petitjean | 273/186.2 |
| 4,789,158 | 12/1988 | Chiesa | 273/163 A |
| 5,074,564 | 12/1991 | Rilling | 273/186.1 |
| 5,299,802 | 4/1994 | Bouchet-Lassale | 273/81 D |

*Primary Examiner*—Steven B. Wong
*Attorney, Agent, or Firm*—Robert M. Downey

[57] ABSTRACT

A dual purpose training device for use with a golf club includes a base member having an inner concave side for releasable attachment to a golf club handle and an outer contoured side configured to guide a user's hands and fingers about the base member and handle in a predetermined manner to achieve a desired grip. A riser defined by a hollow tubular elongate member having a metal ball movably contained therein is releasably attachable to the base member so that it extends in substantially perpendicular relation to the base member, the ball striking opposite ends of the tubular member at predetermined positions throughout a proper golf swing to audibly indicate proper alignment and orientation of the golf club and hands, at various positions of the swing. The base member can be used independently as a grip teaching aid or in combination with the tubular member to also practice and develop a proper golf swing.

5 Claims, 2 Drawing Sheets

DUAL PURPOSE GOLF TRAINING DEVICE

BACKGROUND OF THE INVENTION

1. Field of the Invention

The present invention relates to a golf training device, and more particularly, to a training device for use with a golf club to teach a proper grip and swing of the club.

2. Description of the Related Art

In recent years, the popularity of golf has increased greatly, both as a competitive sport and as a means of recreation. More and more people are discovering golf as a means of socializing or as an outlet to relieve stress and just get away from the daily routine and enjoy the outdoors for a few hours. However, learning to play golf with any degree of skill can be a frustrating experience. The grip, the stance, and the mechanics of the swing all involve complex movements which are difficult to coordinate and repeat with each swing. A flaw in any aspect of the grip, stance or swing will adversely affect the resultant path of flight of the golf ball.

Acquiring the proper skills to have a good golf game takes know how and a lot of practice to develop proper muscle memory. For many golfers, even know how and practice doesn't improve their game beyond a certain level. Once a golfer develops bad habits in the grip and swing, it is very difficult to make any changes, as these bad habits become reinforced in the muscle memory.

There are numerous methods which have been developed to improve a golfer's game. Some of these methods can be learned by taking lessons from a golf pro. However, a series of lessons is usually required to make any appreciable improvement, and the cost associated with such lessons is significant. Numerous instructional videos and books are also available to help golfers improve their skills. However, videos and books only provide general fundamentals and do not address a golfer's individual problems. Further, they do not provide the capability for a golfer to identify problems occurring during his swing because the golfer has no way of analyzing his swing and correcting problems when in the act of swinging.

Many devices have been developed over the years to help improve a golfer's swing; some have merit while others are purely gimmicks. Of particular interest is a device in the related art shown in U.S. Pat. No. 5,074,564, directed to a golf swing aid. The golf swing aid is designed to improve a golfer's swing by controlling the rhythm and tempo of the swing. To accomplish this, the device is aimed towards teaching the golfer to pause during his backswing and follow through by producing an audible sound to indicate to the golfer that the backswing and follow through have been completed. The audible signal is produced by a spring holding a pellet within a bore, which compresses during the backswing as well as the swing and then propels the pellet into a diaphragm when there is a pause in the swing. However, the golf swing aid does not provide means for improving a golfer's grip, nor does it assist the golfer to acquire the proper orientation of his hands and the golf club throughout the swing. Further, the audible sound produced by this device only results at the backswing pause and completion of the follow through, thereby limiting the number of check points in the swing at which there is an indicator.

Other devices have also focused on controlling the speed of the golfer swing. Examples of these devices are shown in U.S. Pat. Nos. 4,515,368, and 3,106,403. However, these devices do not provide means for improving a golfer's grip, nor do they assist the golfer in acquiring the proper orientation of his hands and the golf club throughout the swing.

None of the devices known in the related art provide a dual purpose of teaching a proper grip as well as developing a proper swing.

The present invention is a dual purpose device designed to teach a proper grip and swing in a manner not previously known by providing a contoured handle to force the user to grip the club properly and an indicator for providing visual and audible signals to indicate that the club is properly oriented at predetermined points throughout the golf swing. Thus, a golfer can identify problems with his grip or swing and easily determine how to correct those problems. The device may be used with any golf club, at home or on a golf course. Further, the handle may be used alone to work on the proper grip or it may be used with the indicator to also perfect a golfer's swing.

SUMMARY OF THE INVENTION

The present invention relates to a dual purpose training device for use with a golf club to teach the proper grip and swing. The device includes a base member having an inner concave side structured for releasable attachment to a golf club handle and an outer contoured side configured to guide a user's hands and fingers about the base member and club handle in a predetermined manner to achieve a desired grip. A riser defined by a hollow tubular elongate member and having a metal ball movably contained therein is releasably attached to the base member so that it extends in substantially perpendicular relation to the base member and the longitudinal axis of the golf club shaft when the base member is attached to the golf club. The training device provides visual and audible indicators to help achieve proper orientation of the user's hands and the golf club at various positions throughout the golf swing. The visual indication is provided by observing the orientation of the riser relative to the shaft, the golfers body and the ball. The audible indication is produced by the metal ball striking the inner surface of the ends of the riser. Accordingly, the base member can be used independently to learn the proper grip or in combination with the riser to simultaneously practice and develop a proper swing and grip.

With the foregoing in mind, it is an object of the present invention to provide a dual purpose training device structured for removable attachment to a golf club and specifically designed to teach a proper grip of the club handle.

It is yet another object of the present invention to provide a training device for use with a golf club designed to help keep the club face square with the golf ball.

It is a further object of the present invention to provide a dual purpose training device including means to indicate a proper swing of a golf club.

These and other objects and advantages of the present invention will become more readily apparent in the description which follows.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 3:
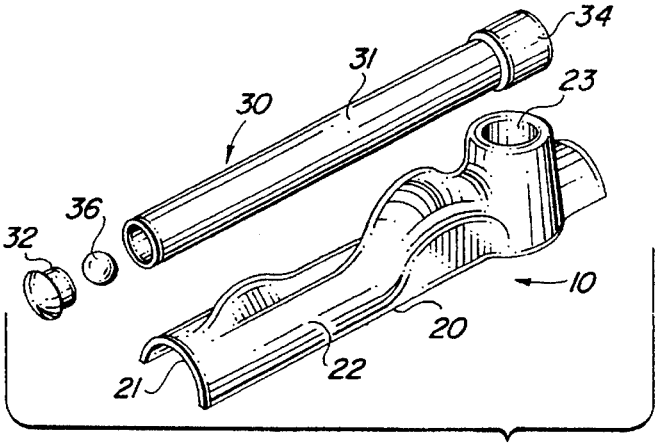
FIG. 3 is an isolated view of the base member and riser.
Figure 1:
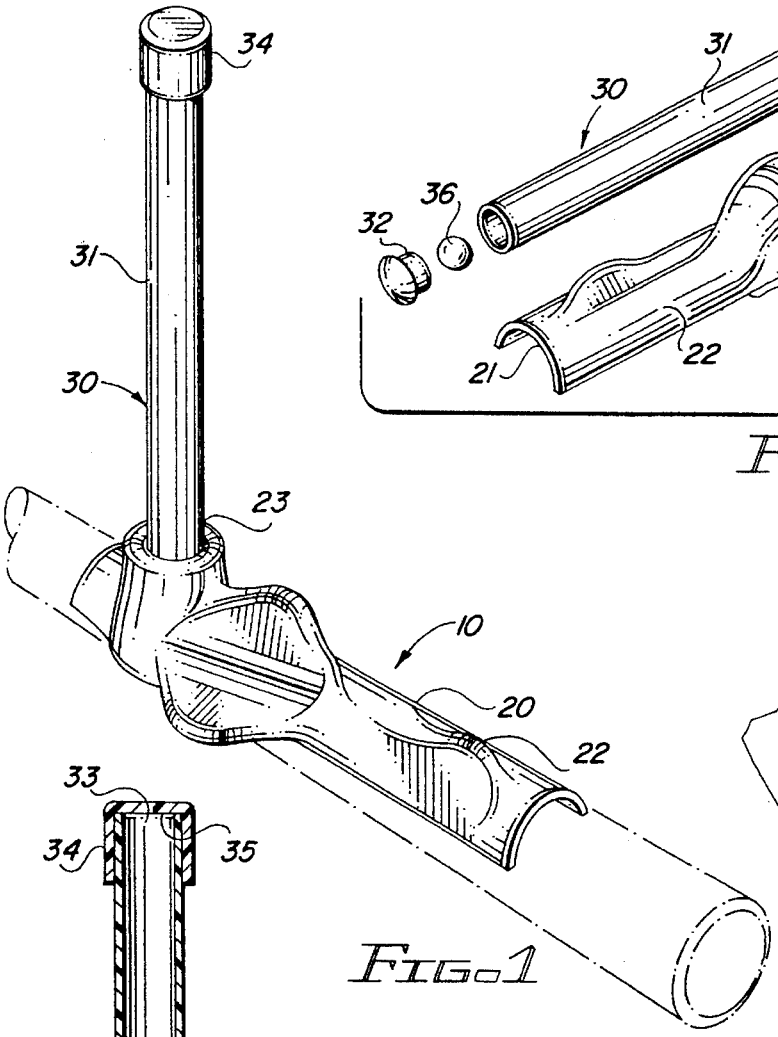
FIG. 1 is a side perspective view of the training device of the present invention.

With reference to FIGS. 1–4E, the present invention is directed to a dual purpose training device for use with a golf club having a club head, a shaft with a longitudinal axis and a handle on an end zone of the shaft. The training device, generally indicated as 10, includes a base member 20 and an indicator 30. The base member 20 includes an inner concave side 21, an outer contoured side 22 and a port 23. The inner concave side 21 is structured to overlie and releasably grasp the exterior surface of the golf club handle and extend along at least a portion of a length of the handle in coaxial relation to the longitudinal axis of the golf club shaft. The outer side 22 is contoured and configured to guide a user's hands and fingers about the base member 20 and attached golf club handle in a predetermined manner to achieve a desired grip. The port is structured to releasably capture the indicator 30 therein so that the indicator 30 extends in substantially perpendicular relation to the base member 20, and the longitudinal axis of the golf club shaft when the base member 20 is attached to the golf club.

The indicator 30 is structured to visibly and audibly indicate the proper orientation of the user's hands and the golf club at predetermined positions during the golf swing. The indicator 30 includes a riser 31 and a metal ball 36. The riser 31 is defined by a hollow tubular elongate member having a first closed end 32 and an opposite second end 33. A cap 34 having an inner surface 35 structured and disposed to produce an audible sound when struck by the metal ball 36 is fixedly attached to the second end 33 of the riser 31 thereby capturing the metal ball 36 within the riser 31. The first end 32 of the riser 31 is structured to be releasably captured in the port 23 of the base member 20 so that the riser 31 extends in substantially perpendicular relation to the base member 20, and the longitudinal axis of the golf club shaft when the base member 20 is attached to the golf club.

The metal ball 36 is movably located within the hollow tubular member defining the riser 31. The ball 36 is structured and disposed to move within the riser 31 and make contact with the inner surface 35 of the cap 34 and the opposite end 32 when the golf club reaches predetermined positions during the golf swing at the proper orientation, thereby producing an audible sound. The audible sound indicates that the user's hands and the golf club are in the proper orientation when the predetermined positions of the golf swing are reached.

Figure 4A:
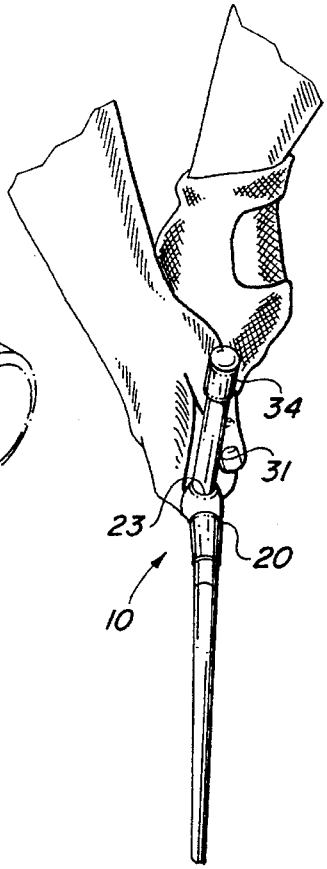
FIG. 4A is a front perspective view of the training device and attached golf club at the address position.
Figure 2:
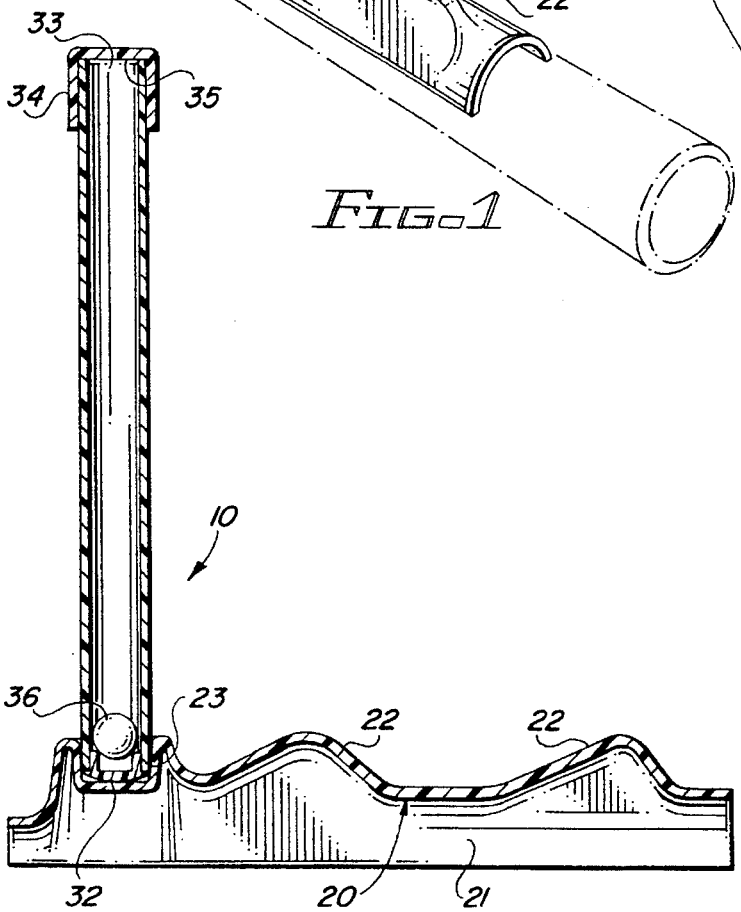
FIG. 2 is a side elevation of the training device shown in partial section illustrating the outer contoured side of the base member and the attached hollow tubular riser with the metal ball contained therein.

With reference to FIGS. 4A–4E, the training device will visually and audibly instruct the user how to achieve the proper orientation of the user's hands and the golf club at predetermined positions throughout the golf swing. As shown in FIG. 4A, the first predetermined position is when addressing the golf ball prior to beginning the swing. At this position, the riser 31 should be pointing straight up relative to the longitudinal axis of the golf club shaft, and the longitudinal axis of the riser 31 should be parallel with the face of the club head.

Figure 4B:
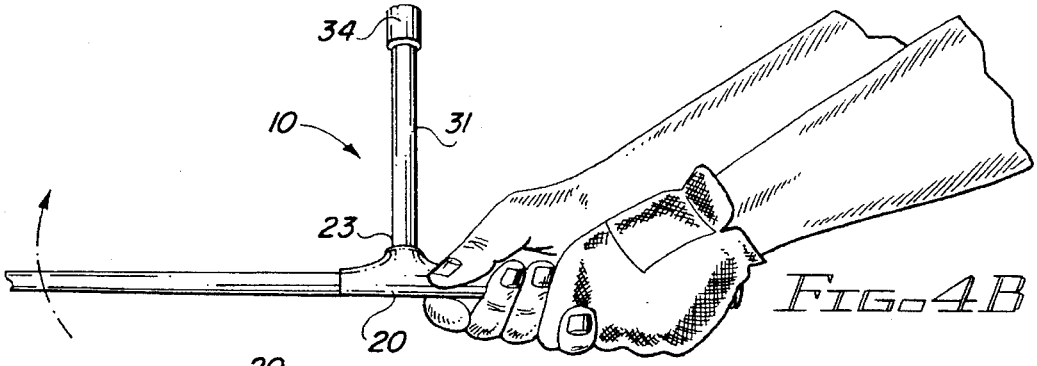
FIG. 4B is a side perspective view of the training device and attached golf club at the takeaway position.

The second predetermined position occurs during the takeaway and is shown in FIG. 4B. At this position, the longitudinal axis of the golf club shaft is parallel to the ground. If the user's hands and the golf club are properly oriented at this position the riser 31 will be pointing straight up, thereby maintaining the club face in the square position.

Figure 4C:
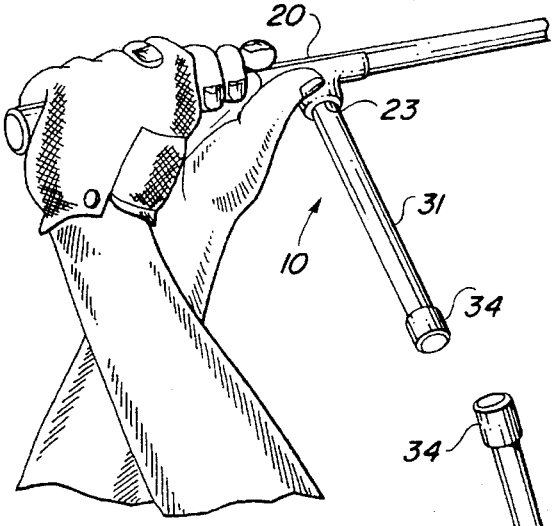
FIG. 4C is a side perspective view of the training device and attached golf club at the backswing set position.

The third predetermined position is the backswing set which occurs at the end of the backswing and is shown in FIG. 4C. If the user's hands and the golf club are properly oriented at this position, the riser 31 will be pointing straight down. This will cause the metal ball 36 to roll towards the second end 33 of the riser 31 and strike the inner surface 35 of the cap 34, thereby producing an audible sound. This sound will indicate to the user that he has reached the backswing set position with his hands and the golf club properly oriented. If the user does not hear the audible sound, either his hands or the golf club are not properly oriented or he has not reached the backswing set position.

Figure 4D:
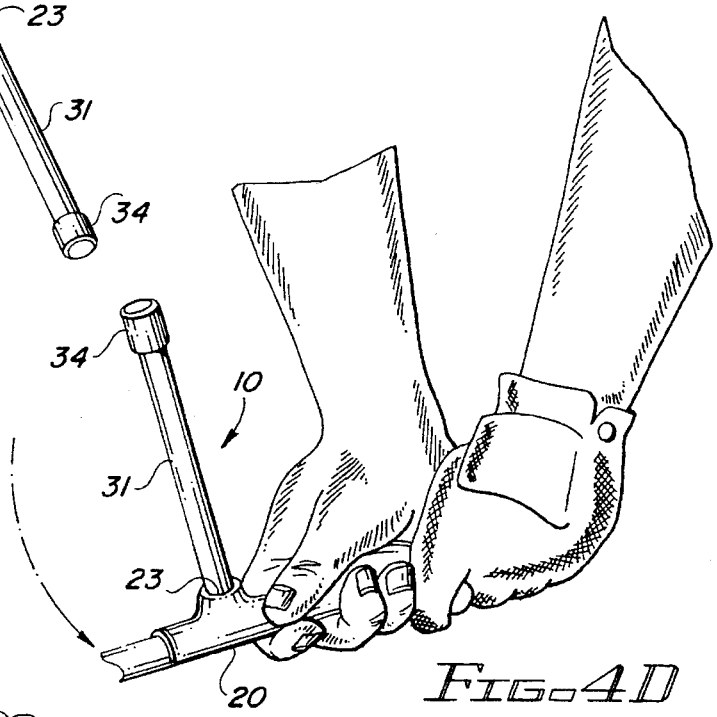
FIG. 4D is a side perspective view of the training device and attached golf club at the downswing position.

The fourth predetermined position occurs during the downswing prior to striking the golf ball and is shown in FIG. 4D. If the user's hands and the golf club are properly oriented at this position, the riser 31 will be pointing straight up relative to the longitudinal axis of the golf club shaft.

Figure 4E:
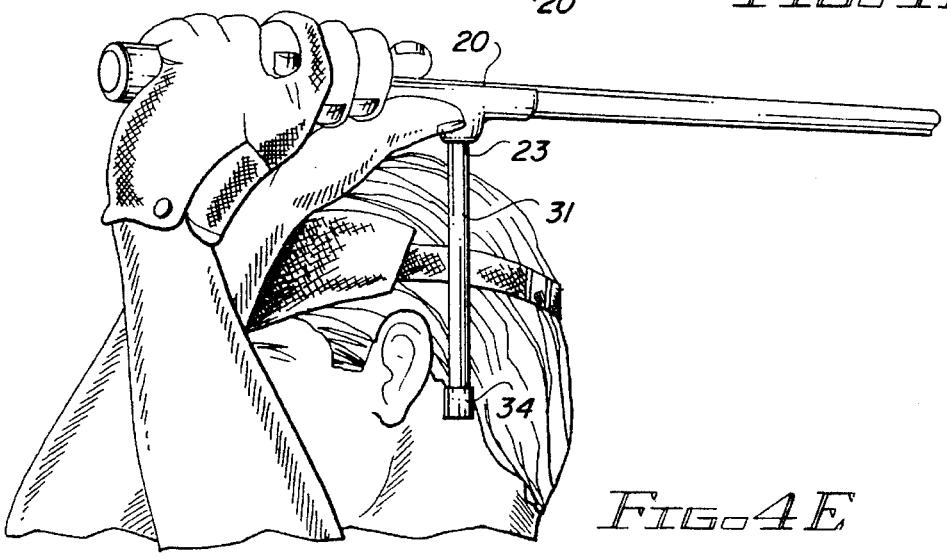
FIG. 4E is a side perspective view of the training device and attached golf club at the follow-thru reset position.

The fifth predetermined position is the follow through reset which occurs at the end of the follow through and is shown in FIG. 4E. At this position, if the user's hands and the golf club are properly oriented, the longitudinal axis of the golf club shaft will be parallel to the ground and the riser 31 will be pointing straight down. This will cause the metal ball 36 to roll towards the second end 33 of the riser 31 and strike the inner surface 35 of the cap 34, thereby producing an audible sound. This sound will indicate to the user that he has reached the follow through reset position with his hands and the golf club properly oriented. If the user does not hear the audible sound, either his hands or the golf club are not properly oriented or he has not reached the follow through reset position.

The present invention can be utilized with any golf club, wedge through driver. The base member may be used alone to learn the proper grip, or the riser may be inserted into the base member to provide visual and audible guidance to achieve the proper club orientation throughout the golf swing.

The present invention will teach the user the proper grip, to keep the club face square, to set the club in the backswing and to reset during the follow through using visual and audible means. By proper use of the present invention, the user will build muscle memory and attain greater accuracy and distance by learning the proper grip and swing.

What is claimed is:

1. A training device for use on a golf club having a club head, a shaft having a longitudinal axis and a handle on an end zone of the shaft, said training device comprising:

a base member structured for removable attachment to the golf club handle in at least partially overlaying relation thereto and extending in coaxial relation to the longitudinal axis of the shaft and including gripping means thereon for gripping the base member and the golf club handle when said base member is attached thereto, said gripping means being contoured and configured to guide a user's hands and fingers about the base member and handle in a predetermined manner to achieve a desired grip, an indicator for visually and audibly indicating proper orientation of the user's hands and the golf club at predetermined positions throughout a range of swing of the golf club from an initial address position to a follow through set position in accordance with established principles defining a proper swing of a golf club, said indicator including a riser defined by a hollow tubular elongate member having a first closed end and an opposite second end, said riser being releasably attached to said base member so as to extend in substantially perpendicular relation to the longitudinal axis of the golf club shaft, said indicator further including a sound producing element within said hollow tubular member structured and disposed to produce an audible signal when the golf club reaches said predetermined positions through the swing, thereby audibly indicating that the user's hands and the golf club are in the proper orientation at said predetermined positions.

2. A training device for use on a golf club as recited in claim 1 wherein said base member includes an inner concave side structured to overlie and releasably grasp the handle of the golf club.

3. A training device for use on a golf club as recited in claim 2 wherein said base member further includes an outer side having said gripping means formed thereon.

4. A training device for use on a golf club as recited in claim 1 wherein said riser includes a cap fixedly attached to said second opposite end of said tubular member, said cap including an inner surface structured and disposed for contact with said sound producing element to produce said audible signal.

5. A training device for use on a golf club as recited in claim 4 wherein said sound producing element is a metal ball movable along at least a portion of a length of said hollow tubular member so that said metal ball contacts said inner surface of said cap when the user's hand and the golf club are in the proper orientation at said predetermined positions.

* * * * *